US006145530A

United States Patent [19]

Fernandez

[11] Patent Number: 6,145,530

[45] Date of Patent: Nov. 14, 2000

[54] VENTING CAP WITH YIELDABLE PLASTIC RING

[75] Inventor: Michael A. Fernandez, Keansburg, N.J.

[73] Assignee: Girard Equipment Inc., Rahway, N.J.

[21] Appl. No.: 09/414,587

[22] Filed: Oct. 8, 1999

[51] Int. Cl.[7] ..... F16K 17/40

[52] U.S. Cl. ..... 137/74

[58] Field of Search ..... 137/74

[56] References Cited

U.S. PATENT DOCUMENTS 4,139,005 2/1979 Dickey ..... 137/74

5,762,091 6/1998 Sarne et al. ..... 137/74

5,791,367 8/1998 Hackman et al. ..... 137/74

*Primary Examiner*—Gregory L. Huson

*Assistant Examiner*—Ramesh Krishnamurthy

*Attorney, Agent, or Firm*—R. Gale Rhodes, Jr.

[57] ABSTRACT

A cap for venting a tank containing a fluid which expands in response to heat applied externally to the tank and which cap includes an outer annular nut, an inner circular central disc, and an intermediate annular ring of polymer-based material which softens in response to the externally applied heat to permit the inner circular central disc to be blown out of the outer annular nut thereby venting the tank and preventing the tank from exploding.

8 Claims, 2 Drawing Sheets

VENTING CAP WITH YIELDABLE PLASTIC RING

BACKGROUND OF THE INVENTION

This invention relates to a cap for venting a tank containing a fluid, such as for example a volatile liquid, and for preventing the tank from exploding upon the fluid in the tank expanding in response to externally applied heat.

Caps are known to the art for venting a tank to the atmosphere and for preventing the tank from exploding upon the fluid contained in the tank expanding in response to externally applied heat. Such prior art caps typically include an outer annular nut, an inner or circular central disc, and an annular ring of a fusible low melt alloy intermediate and interconnecting the outer annular nut and the inner or circular central disc. Typically such fusible low melt alloys contain lead and a commonly used fusible low melt alloy containing lead is a lead-bismuth alloy. Such prior art caps are typically used to vent tanks such as, for example, trailer tanks, storage tanks, and intermediate bulk tanks. Such tanks contain, for example, petrochemical liquids, such as for example gasoline, and pharmaceutical and food grade liquids.

The use of the above-noted lead-based fusible rings has become objectionable due to the fact that the lead can possibly contaminate pharmaceutical and food grade liquids and the use of lead-based fusible rings is also objectionable due to the fact that upon disuse and disposal of a cap including the lead-based fusible ring in a land fill, for example, the lead in the fusible ring can contaminate the environment.

Accordingly, there is a need in the art for a cap which does not include lead and which cap can vent a tank to prevent the tank from exploding upon liquid contained in the tank expanding in response to externally applied heat.

SUMMARY OF THE INVENTION

A cap for venting a tank containing a fluid which expands in response to heat applied externally to the tank and which cap includes an outer annular nut, an inner circular central disc, and an intermediate annular ring of polymer-based material which softens in response to the externally applied heat to permit the inner circular central disc to be blown out of the outer annular nut thereby venting the tank and preventing the tank from exploding.

DETAILED DESCRIPTION OF THE INVENTION

Figure 1:
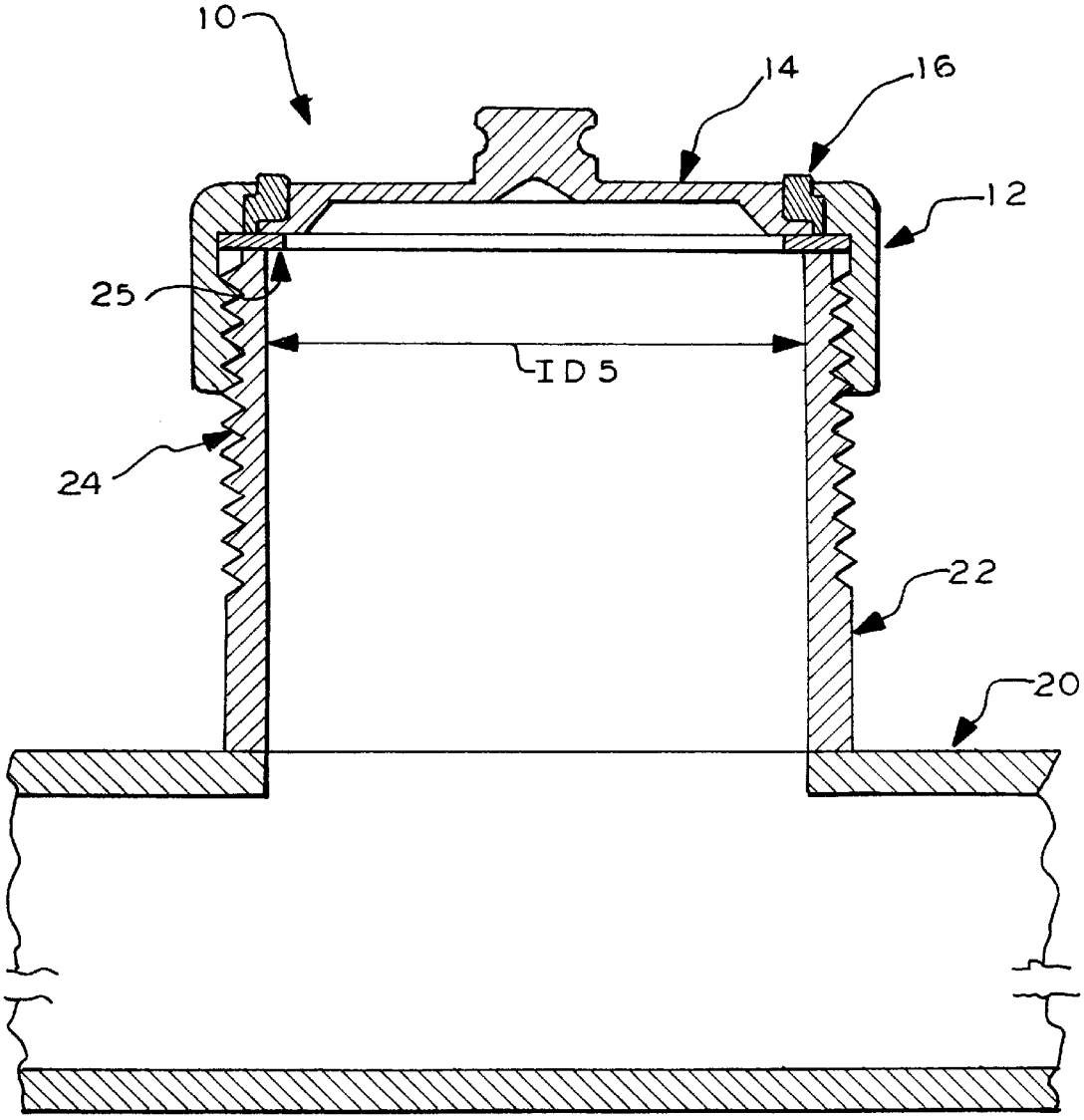
FIG. 1 is a vertical, cross-sectional view of components comprising the cap of the present invention and a tank and a nipple mounted to the tank.

Referring to FIG. 1, a cap embodying the present invention is shown and identified by general numerical designation 10. Cap 10 includes an outer annular nut 12, an inner or circular central disc 14, and an intermediate annular ring of polymer-based material 16 residing intermediate the outer annular nut 12 and the circular central disc 14. A tank for containing fluids of the type noted above in the Background of the Invention is shown in partial cross-sectional view and is identified by general numerical designation 20. Tank 20 is provided with an upwardly extending hollow cylindrical nipple also shown in cross-section and identified by general numerical designation 22. Typically the tank 20 and the nipple 22 are made of stainless steel with the nipple 22 being mounted suitably to the tank 20 such as by brazing or welding. The upper outer portion of the nipple 22 is provided with external threads indicated by general numerical designation 24. An annular gasket 25 may be included to provide a seal between the cap 10 and the nipple 22.

Figure 2:
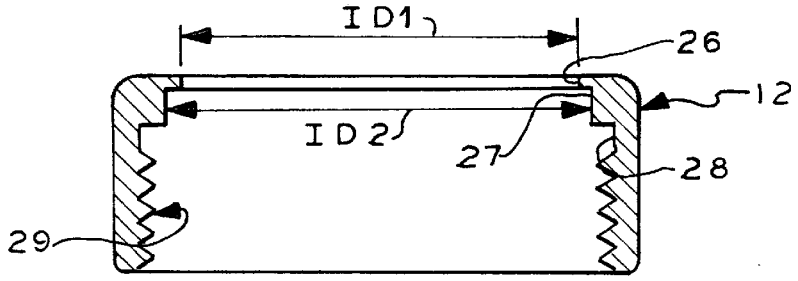
FIG. 2 is a separate view of the outer annular nut shown in cross-section in FIG. 1.

Referring to FIG. 2, the outer annular nut 12 includes an inwardly extending upper inner annular portion 26 having an inner diameter ID1, an intermediate inner annular portion 27 having an inner diameter ID2 and a downwardly extending annular lower portion 28 provided with internal threads 29.

Figure 3:
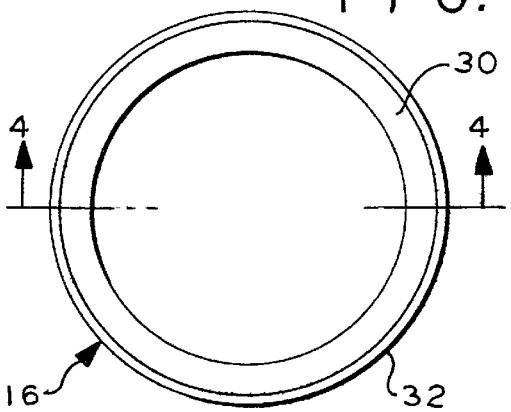
FIG. 3 is a top or plan view of the intermediate annular ring of polymer-based material shown in FIG. 1.
Figure 4:
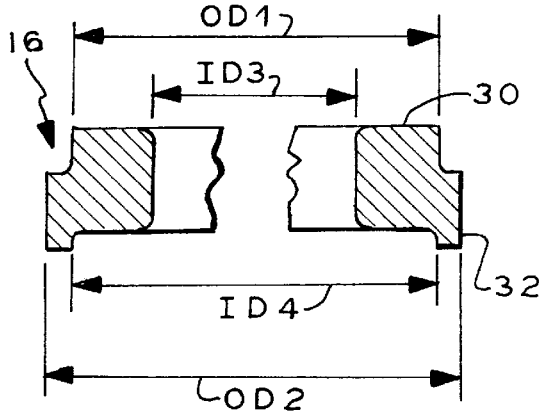
FIG. 4 is an enlarged cross-sectional view taken generally along the line 4—4 in FIG. 3 in the direction of the arrows.

The intermediate annular ring 16 of polymer-based material, FIGS. 3 and 4, includes an upwardly extending upper inner annular portion 30 having, as shown in FIG. 4, an inner diameter ID3 and an outer diameter OD1. The intermediate annular ring 16 also includes a downwardly extending lower outer annular portion 32 having an inner diameter ID4 and an outer diameter OD2.

Figure 5:
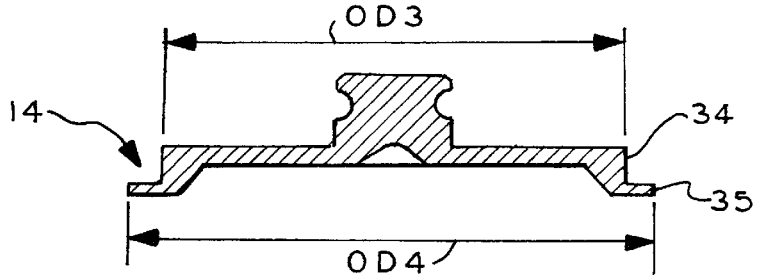
FIG. 5 is a separate view of the circular central disc shown in cross-section in FIG. 1.

Referring to FIG. 5, the inner circular central disc 14 includes an upwardly extending upper inner circular portion 34 having an outer diameter OD3 and an outwardly extending lower outer circular portion 35 having an outer diameter OD4.

The liquids of the types noted above in the Background of the Invention contained in a tank, such as the tank 20, shown in FIG. 1, typically expand to the point of exploding the tank upon the external temperature of the heat applied to the tank exceeding a regulatory specified temperature, typically, 250° F.–300° F. The intermediate annular ring of polymer-based material 16 may be, for example, low-density polyethylene having a yielding point of about 230° F.–250° F., polypropylene having a yielding point of about 270° F. or high density polyethylene having a yielding point of about 260° F. Accordingly it has been found that upon the intermediate annular ring 16 of polymer-based material 16 being made of the above-noted low-density polyethylene, polypropylene, or high density polyethylene, it will yield, or soften, sufficiently before or in advance of the tank exploding to permit the central disc 14 to be blown out of the outer annular nut 12 (FIG. 1) before the tank explodes whereby the tank is vented to the atmosphere and tank explosion is avoided; it will be noted from FIGS. 1, 2 and 5 that the outer diameter OD4 of the inner circular central disc 14 is smaller than the inner diameter ID1 of the outer annular nut 12 which permits the circular disc 16 to be blown through the outer annular nut 12 upon the intermediate annular ring of polymer based material yielding. From FIGS. 1, 2 and 5, it will be noted that the outer diameter OD4 of the circular central disc 14 (FIG. 5) is greater than the inner diameter ID5 of the nipple 22 (FIG. 1) which prevents the central disc 14 from falling into the nipple 22 and into the tank 20 upon the intermediate annular ring of polymer-based material 16 yielding.

It will be understood that the outer diameter OD3 (FIG. 5) of the upper circular portion 34 of the circular central disc 14 is substantially equal to the inner diameter ID3 (FIG. 4) of the upwardly extending upper inner annular portion 30 of the intermediate annular ring 16 of polymer-based material but dimensioned to permit the upper circular portion 34 of the circular central disc 14 to be received within the upwardly extending upper inner annular portion 30 of the intermediate annular ring 16. It will be further understood that the outer diameter OD4 (FIG. 5) of the circular central disc 34 is substantially equal to the inner diameter ID4 (FIG. 4) of the downwardly extending lower annular portion 32 of the intermediate annular ring 16 but dimensioned to permit the lower circular portion 35 of the central disc 14 to be received within the downwardly extending lower annular portion 32 of the intermediate annular ring 16. It will be still further understood that the outer diameter OD1 (FIG. 4) of the intermediate annular ring 16 is substantially equal to the inner diameter ID1 (FIG. 2) of the inwardly extending upper annular portion 25 of the outer annular nut 12 but dimensioned to permit the upwardly extending upper annular portion 30 of the intermediate annular ring 16 to be received within the inwardly extending upper annular portion 25 of the outer annular nut 12. Additionally, it will be understood that the outer diameter OD2 (FIG. 4) of the downwardly extending lower portion 32 of the intermediate annular ring 16 is substantially equal to the inner diameter ID2 (FIG. 2) of the intermediate inner annular portion 27 of the outer annular nut 12 but dimensioned to permit the downwardly extending outer annular portion 32 of the intermediate annular ring 16 to be received within the intermediate inner annular portion 27 of the outer annular nut 12.

In assembly, the circular central disc 14 is inserted into the intermediate annular ring 16 of polymer-based material with the upper circular portion 34 of the circular central disc 14 being inserted into the upper inner annular portion 30 of the ring 16 and with the lower outer circular portion 35 of the circular central disc 14 being inserted into the lower outer annular portion 32 of the intermediate annular ring 16; upon such insertion, the tops of the circular central disc 14 and the intermediate annular ring 16 of polymer-based material are substantially co-planar. The sub-assembly of the intermediate annular ring 16 of polymer-based material and the circular central disc 14 are then inserted into the outer annular nut 12 with the upwardly extending inner annular portion 30 of the intermediate annular ring 16 being inserted into the inwardly extending upper annular portion 26 of the outer annular nut 12 and with the lower outer annular portion 32 of the intermediate annular ring 16 being inserted into the intermediate annular portion 27 of the outer annular nut 12; upon such insertion, the tops of the circular central disc 14, the intermediate annular ring 16 of polymer-based material, and the outer annular nut 12 are substantially co-planar. The internal threads 29 provided on the downwardly extending lower annular portion 28 of the outer annular nut 12 are then threaded into engagement with the external threads 24 (FIG. 1) provided on the upper portion of the nipple 22 and such threaded engagement forces the intermediate annular ring 16 of polymer-based material into sealing engagement with the outer annular nut 12 and the inner circular central disc 14 which prevents fluid contained in the tank 20 (FIG. 1), under normal conditions, from escaping through the cap 10; such threading also forces the annular gasket 25 (FIG. 1) into sealing engagement with the top of the nipple 22 to provide a seal between the cap 10 and the nipple 22.

In the preferred embodiment, the annular nut 12 and inner central disc 14 were made of a suitable metal such as, for example, stainless steel.

It will be understood by those skilled in the art that many variations and modifications may be made in the present invention without departing from the spirit and the scope thereof.

What is claimed is:

1. A cap for venting a tank containing a fluid which can expand to the point of exploding the tank upon sufficient external heat being applied to the tank, comprising:

an outer metal member for being connected to the tank;

an inner metal member; and an intermediate member intermediate and for interconnecting the outer metal member and the inner metal member, said intermediate member made of a yieldable polymer-based material and for yielding in response to external heat applied to the tank to permit said inner metal member to be blown out of said outer metal member to vent the tank to the atmosphere prior to the tank exploding.

2. The cap according to claim 1 wherein said polymer-based material is low density polyethylene having a yielding point of about 230° F.–250° F.

3. The cap according to claim 1 wherein said polymer-based material is polypropylene having a yielding temperature of about 270° F.

4. The cap according to claim 1 wherein said polymer-based material is high density polyethlene having a yielding point of about 260° F.

5. The cap according to claim 1 wherein the tank is provided with an outwardly extending hollow cylindrical nipple provided with external threads, wherein said outer metal member is an outer annular metal nut, wherein said inner metal member is a circular central metal disc, and wherein said intermediate member made of said polymer-based material resides between and provides a fluid-tight seal between said outer annular metal nut and said circular central metal disc prior to yielding.

6. The cap according to claim 5 wherein said outer annular metal nut includes an upper inner annular portion having a first inner diameter ID1, an intermediate annular portion having a second inner diameter ID2 and a lower annular portion provided with internal threads for threadedly engaging said external threads, wherein said intermediate annular ring of polymer-based material includes an upwardly extending upper inner annular portion having a third inner diameter ID3 and a first outer diameter OD1 and includes a downwardly extending lower outer annular portion having a second outer diameter OD2 and a fourth inner diameter ID4, said circular central metal disc including an upwardly extending upper inner circular portion having an outer diameter OD3 and an outwardly extending lower outer circular portion having an outer diameter OD4, wherein said nipple has an inner diameter ID5 and an outer diameter OD5, wherein said inner diameter ID1 of said outer annular metal nut is substantially equal to said outer diameter OD1 of said intermediate annular ring, wherein said inner diameter ID2 of said outer annular metal nut is substantially equal to said outer diameter OD2 of said intermediate annular ring, wherein said inner diameter ID3 of said intermediate annular ring is substantially equal to said outer diameter OD3 of said circular central disc and wherein said inner diameter ID4 of said intermediate annular ring is substantially equal to said outer diameter OD4 of said circular metal disc, wherein said inner diameter ID2 of said outer annular metal nut is substantially equal to said outer diameter OD5 of said nipple and wherein said outer diameter OD4 of said circular central metal disc is greater than said inner diameter ID5 of said nipple.

7. The cap according to claim 6 wherein said circular central disc is received within said intermediate annular ring and wherein said circular central disc and said intermediate annular ring are received within said outer annular nut.

8. The cap according to claim 1, wherein the tank is provided with an outwardly extending hollow cylindrical nipple provided with external threads and including an annular top, wherein said cap further includes a gasket intermediate said annular top of said nipple and said outer metal member, said metal inner member and said intermediate member, said gasket, said outer metal member and said inner metal member isolating said intermediate member from the fluid contained in the tank.

* * * * *